US011408256B2

(12) United States Patent
Dikshit et al.

(10) Patent No.: US 11,408,256 B2
(45) Date of Patent: Aug. 9, 2022

(54) SYSTEM AND METHODOLOGY TO INTEGRATE M-TOOL NOZZLE WITH SAND SCREEN

(71) Applicant: Schlumberger Technology Corporation, Sugar Land, TX (US)

(72) Inventors: Ashutosh Dikshit, Houston, TX (US); Michael Plooy, Edmonton (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/078,123

(22) Filed: Oct. 23, 2020

(65) Prior Publication Data

US 2021/0123326 A1 Apr. 29, 2021

Related U.S. Application Data

(60) Provisional application No. 62/925,344, filed on Oct. 24, 2019.

(51) Int. Cl.
*E21B 43/08* (2006.01)
*E21B 43/04* (2006.01)

(52) U.S. Cl.
CPC ..... *E21B 43/08* (2013.01); *E21B 43/04* (2013.01)

(58) Field of Classification Search
CPC ..... E21B 43/04; E21B 43/08; E21B 43/088; E21B 43/086
See application file for complete search history.

(56) References Cited

U.S. PATENT DOCUMENTS

| | | | | |
|---|---|---|---|---|
| 9,518,455 | B2 * | 12/2016 | Franklin | E21B 43/08 |
| 9,828,838 | B2 * | 11/2017 | Lopez | E21B 43/088 |
| 10,385,661 | B2 * | 8/2019 | Kang | E21B 43/086 |
| 2010/0200247 | A1 * | 8/2010 | Dybevik | E21B 43/162 166/380 |
| 2016/0215598 | A1 * | 7/2016 | Lopez | E21B 43/088 |
| 2018/0283132 | A1 * | 10/2018 | Techentien | E21B 43/08 |
| 2020/0256163 | A1 | 8/2020 | Fermaniuk et al. | |
| 2021/0172299 | A1 * | 6/2021 | Fermaniuk | E21B 43/08 |

FOREIGN PATENT DOCUMENTS

| | | | |
|---|---|---|---|
| WO | 2019068164 | A1 | 4/2019 |
| WO | 2019090425 | A1 | 5/2019 |
| WO | 2019213782 | A1 | 11/2019 |
| WO | 2020010449 | A1 | 1/2020 |
| WO | 2020028994 | A1 | 2/2020 |
| WO | 2020069614 | A1 | 4/2020 |
| WO | 2020168438 | A1 | 8/2020 |

* cited by examiner

*Primary Examiner* — Michael R Wills, III
(74) *Attorney, Agent, or Firm* — Matthew Goode

(57) ABSTRACT

A sand control assembly includes a base pipe having at least one perforation, a housing, and at least one inflow control device integrated within the housing via an associated ring secured to the housing and the base pipe, the at least one inflow control device and the associated ring creating a seal. The housing is disposed around the exterior of the base pipe, and the housing is secured to a bypass ring at a first end of the housing and secured to the base pipe at a second end of the housing via a weld end ring. A longitudinal axis of the at least one inflow control device is parallel to a longitudinal axis of the base pipe.

17 Claims, 10 Drawing Sheets

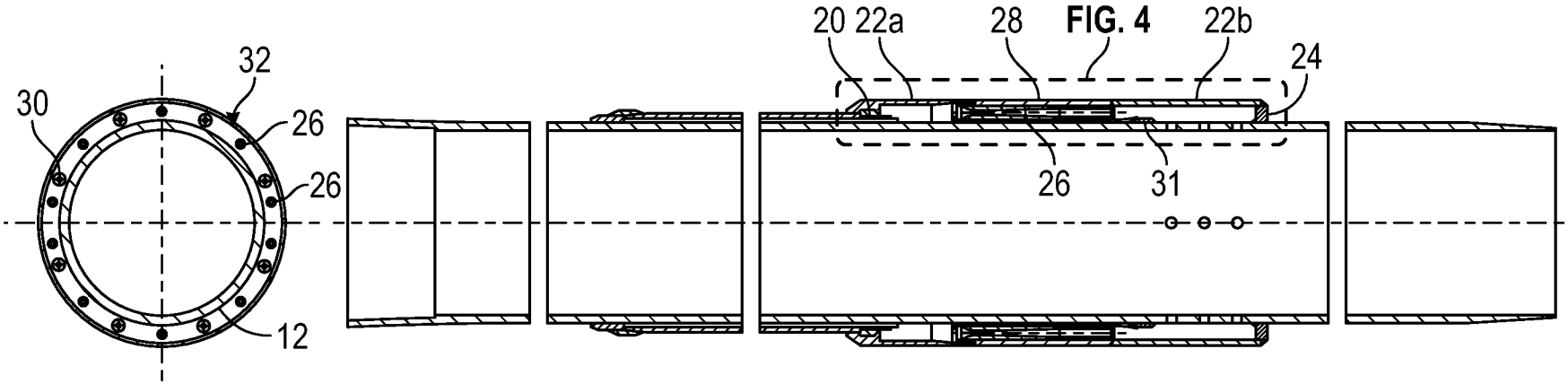
FIG. 4
FIG. 3B
FIG. 3A
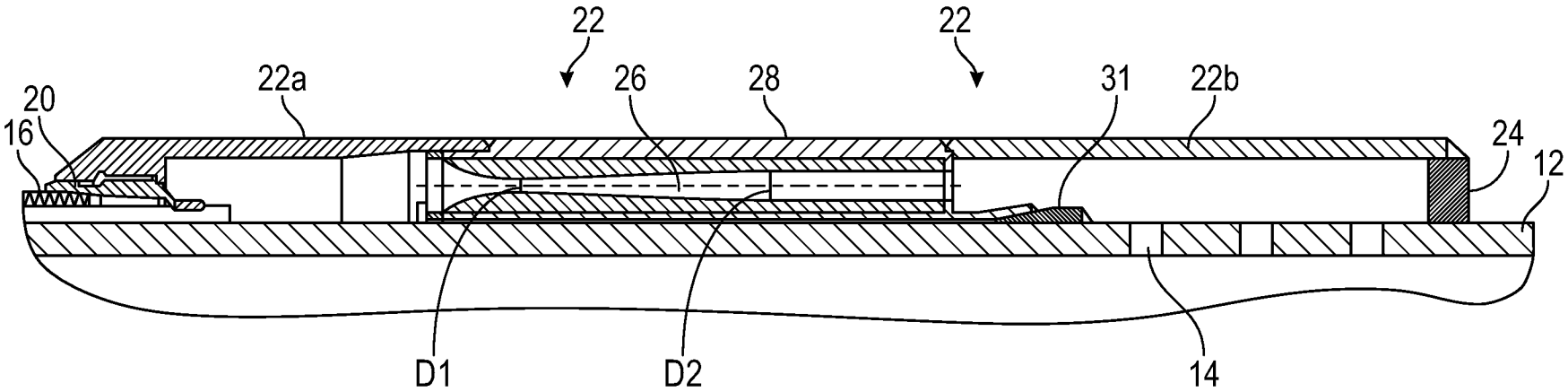
FIG. 4

SYSTEM AND METHODOLOGY TO INTEGRATE M-TOOL NOZZLE WITH SAND SCREEN

CROSS-REFERENCE TO RELATED APPLICATION

The present document is based on and claims priority to U.S. Provisional Patent Application Ser. No. 62/925,344, filed Oct. 24, 2019, which is incorporated herein by reference in its entirety.

BACKGROUND

Gravel packs are used in wells for removing particulates from inflowing hydrocarbon fluids. In a variety of applications, gravel packing is performed in long horizontal wells by pumping slurry comprising gravel suspended in a carrier fluid down the annulus between the wellbore wall and screen assemblies. The slurry is then dehydrated by returning the carrier fluid to the surface after depositing the gravel in the wellbore annulus. To return to the surface, the carrier fluid flows inwardly through the screen assemblies and into a production tubing which routes the returning carrier fluid back to the surface. In some applications, there is a need to integrate inflow control devices (or nozzles) with the screen assemblies to provide control over the inflow of production fluids.

SUMMARY

A sand control assembly according to one or more embodiments of the present disclosure includes a base pipe having at least one perforation, a housing disposed around the exterior of the base pipe, the housing being secured to a bypass ring at a first end of the housing and secured to the base pipe at a second end of the housing via a weld end ring, and at least one inflow control device integrated within the housing via an associated ring secured to the housing and the base pipe, the at least one inflow control device and the associated ring creating a seal, wherein a longitudinal axis of the at least one inflow control device is parallel to a longitudinal axis of the base pipe.

A method according to one or more embodiments of the present disclosure includes providing a perforated base pipe, securing at least one nozzle ring to the base pipe, securing a low pressure housing to the at least one nozzle ring and to the base pipe, inserting a nozzle into each of the at least one nozzle rings such that a longitudinal axis of the nozzle is parallel to a longitudinal axis of the base pipe, forcing the nozzle into each of the at least one nozzle rings, thereby creating a seal, and securing a high pressure housing to the bypass ring and to the at least one nozzle ring.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows:

FIGS. 3A and 3B are different cross-sectional views of a sand control assembly integrating at least one inflow control device, according to one or more embodiments of the present disclosure;

FIG. 4 is an enlarged partial view of the cross-sectional view shown in FIG. 3B of the sand control assembly integrating the at least one inflow control device, according to one or more embodiments of the present disclosure;

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure is a ball valve actuation mechanism that generates force to open the ball valve by moving internal components of the actuation mechanism away from the ball valve. As such, one or more embodiments of the present disclosure generally relate to an isolation valve system having a design that is simpler to manufacture and more reliable to use in a well application. This design utilizes simple mechanisms with lower force requirements that enable reliable and repeatable actuation of a ball type flow isolation valve in debris laden environments. Additionally, the design components involved in actuating the valve may be reduced in size/cross-section due to a reduction in stress on the actuation components, which may reduce manufacturing costs.

Figure 1:
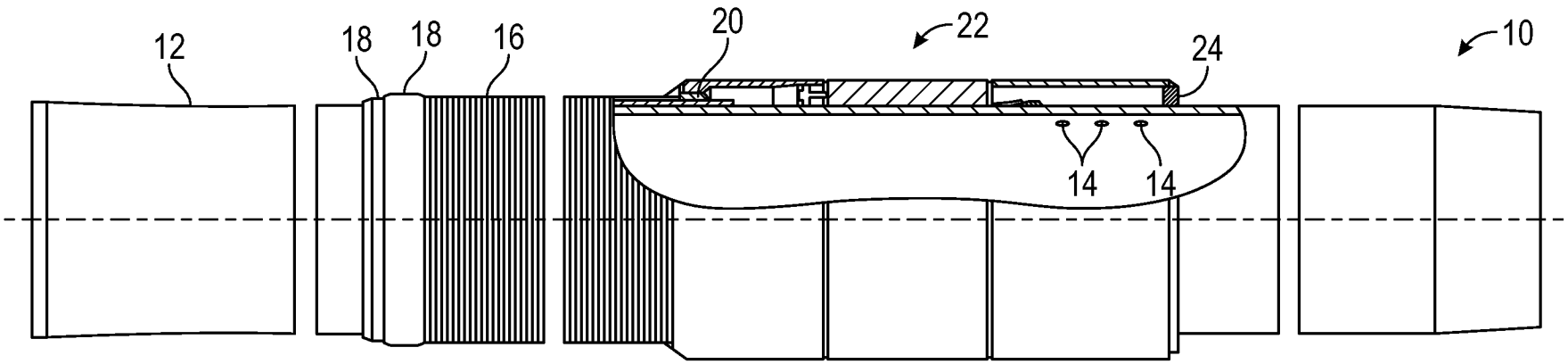
FIG. 1 is a perspective view of a sand control assembly, according to one or more embodiments of the present disclosure.

Referring generally to FIG. 1, a perspective view of a sand control assembly 10 according to one or more embodiments of the present disclosure is shown. Specifically, as shown in FIG. 1, the sand control assembly 10 includes a base pipe 12 having a plurality of perforations 14. While FIG. 1 shows three perforations 14 in the base pipe 12, this number of perforations 14 in the base pipe 12 is not necessarily limiting. In one or more embodiments of the present disclosure, the number of perforations 14 in the base pipe 12 is enough to facilitate a low pressure and high flow rate environment into an interior of the base pipe 12, but not so many so as to compromise the integrity or rigidity of the base pipe 12.

As further shown in FIG. 1, the sand control assembly 10 may also include a filter screen 16 having a first end and a second end. As shown in FIG. 1, the filter screen 16 is secured to an exterior of the base pipe 12 via at least one end ring 18 at the first end. Further, the filter screen 16 is secured to the exterior of the base pipe 12 via a bypass ring 20 at the second end of the filter screen 16, which is more clearly shown in FIG. 4, as further described below. According to one or more embodiments of the present disclosure, the filter screen 16 may be of any type, including a wire wrap screen, or a mesh screen, for example.

Still referring to FIG. 1, the sand control assembly 10 also includes a housing 22 disposed around the exterior of the base pipe 12. As shown, the housing 22 is secured to the bypass ring 20 at a first end, and the housing 22 is secured to the base pipe 12 at a second end via a weld end ring 24, for example. As further shown in FIG. 1, the housing 22 may at least partially cover the filter screen 16 according to one or more embodiments of the present disclosure. Additional details with respect to the housing 22 of the sand control assembly 10 according to one or more embodiments of the present disclosure are provided below.

Figure 2:
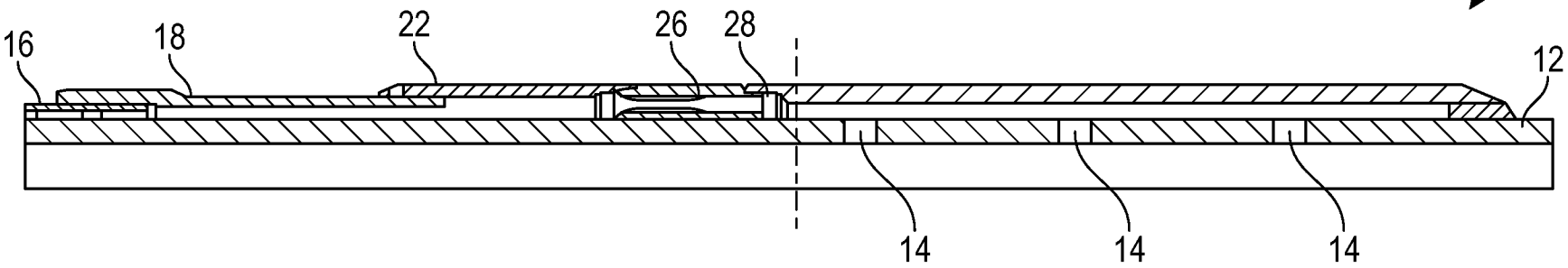
FIG. 2 is a partial cross-sectional view of a sand control assembly integrating at least one inflow control device, according to one or more embodiments of the present disclosure.

Referring now to FIG. 2, a partial cross-sectional view of a sand control assembly 10 according to one or more embodiments of the present disclosure is shown. As shown, the sand control assembly 10 includes a base pipe 12, a plurality of perforations 14, a filter screen 16, at least one end ring 18, and a housing (or cover) 22, as previously described. As further shown in FIG. 2, the sand control assembly 10 includes an inflow control device 26, which may be a nozzle, integrated within the housing 22 via an associated ring 28, which may be a nozzle ring, secured to the housing 22 and the base pipe 12. The integration of the inflow control device or nozzle 26 within the housing 22 of the sand control assembly is further described below.

Referring now to FIGS. 3A and 3B, different cross-sectional views of a sand control assembly 10 integrating at least one inflow control device or nozzle 26 are shown. Specifically, FIG. 3A shows set screws 30 on a face plate of a retaining ring 32, which may be used to affix one or more nozzles 26 around the perimeter of the base pipe 12 of the sand control assembly 10, according to one or more embodiments of the present disclosure. Moreover, FIG. 3B shows a more complete cross-sectional view of the sand control assembly 10 than that previously described with respect to FIG. 2, for example. The circled section "D," as shown in FIG. 3B, which includes, inter alia, the bypass ring 20, the housing 22, which includes a high pressure housing 22*a* and a low pressure housing 22*b*, the weld end ring 24, the nozzle 26, the nozzle ring 28, and a centralizing ring 31, is further described below with respect to FIG. 4. Further, FIG. 3B also shows that the sand control assembly 10 according to one or more embodiments of the present disclosure may include multiple inflow control devices or nozzles 26, for example. Indeed, the sand control assembly 10 according to one or more embodiments of the present disclosure may include first and second inflow control devices or nozzles 26*a*, 26*b* integrated within the housing 22 via associated first and second rings 28*a*, 28*b*, respectively, which may be nozzle rings, secured to the housing 22 and the base pipe 12, the first and second inflow control devices or nozzles 26*a* and the associated first and second rings 28*a*, 28*b* creating a seal. Further, the first and second inflow control devices or nozzles 26*a*, 26*b* may be contoured, each defining a first diameter and a second diameter, according to one or more embodiments of the present disclosure. The first diameter is the smallest diameter of the first and second inflow control devices or nozzles 26*a*, 26*b*, the second diameter is the largest diameter of the first and second inflow control devices or nozzles 26*a*, 26*b*, and the largest diameter is twice the smallest diameter according to one or more embodiments of the present disclosure.

Referring now to FIG. 4, an enlarged partial view of the cross-section view shown in FIG. 3B of the sand control assembly 10 integrating the at least one inflow control device or nozzle 26 is shown. As shown, the nozzle 26 is integrated within the housing 22 via the nozzle ring 28 secured to the high pressure housing 22*a*, the low pressure housing 22*b*, and the base pipe 12. In one or more embodiments of the present disclosure, the nozzle ring 28 is secured or welded to the high pressure housing 22*a*, the low pressure housing 22*b*, and to the base pipe 12. In one more embodiments of the present disclosure, the high pressure housing 22*a* is associated with an inlet of the inflow control device or nozzle 26, and the low pressure housing 22*b* is associated with an outlet of the inflow control device or nozzle 26. In one or more embodiments of the present disclosure, at least an interior wall of the low pressure housing 22*b* may be coated with a protective coating to prevent the effects of erosion. In one or more embodiments of the present disclosure, the protective coating may include tungsten carbide, hardide, carbide, or ceramic, for example. As further shown, a longitudinal axis of the inflow control device or nozzle 26 is parallel to a longitudinal axis of the base pipe 12. FIG. 4 also shows that the sand control assembly 10 may include a centralizing ring 31 secured to the base pipe 12 that centers the inflow control device or nozzle 26 with respect to the base pipe 12, according to one or more embodiments of the present disclosure. That is, in one or more embodiments of the present disclosure, the inflow control device or nozzle 26 may be disposed concentrically with respect to the longitudinal axis of the base pipe 12. In other embodiments of the present disclosure, the inflow control device or nozzle 26 may be disposed eccentrically with respect to the longitudinal axis of the base pipe 12. That is, according to one or more embodiments of the present disclosure, the inflow control device or nozzle 26 may be disposed offset from the longitudinal axis of the base pipe 12.

As further shown in FIG. 4, the nozzle 26 according to one or more embodiments of the present disclosure is contoured, defining a first diameter D1 and a second diameter D2. As shown in FIG. 4, D1 is a smallest diameter of the nozzle 26, and D2 is a largest diameter of the nozzle 26 according to one or more embodiments of the present disclosure. As further shown in FIG. 4, D2 may be twice D1 in one or more embodiments of the present disclosure.

In view of FIGS. 1, 3B, and 4, a method according to one or more embodiments of the present disclosure includes providing a base pipe 12 having a plurality of perforations 14, securing or welding a filter screen 16 having a first end and a second end to an exterior of the perforated base pipe 12 via at least one end ring at the first end and a bypass ring 20 at the second end, securing or welding a nozzle ring 28 to the base pipe 12, securing a low pressure housing 22*b* to the nozzle ring 28 and to the base pipe 12, inserting a nozzle 26 into the nozzle ring 28 such that a longitudinal axis of the nozzle 26 is parallel to a longitudinal axis of the base pipe 12, forcing the nozzle 26 into the nozzle ring 28, thereby creating a seal, and securing or welding a high pressure housing 22*a* to the bypass ring 20 and to the nozzle ring 28. In one or more embodiments of the present disclosure, forcing the nozzle 26 into the nozzle ring 28 to create a seal ensures that no flow from a reservoir external of the sand control assembly 10 bypasses the filter screen 16 or the nozzle 26.

Figure 5A:
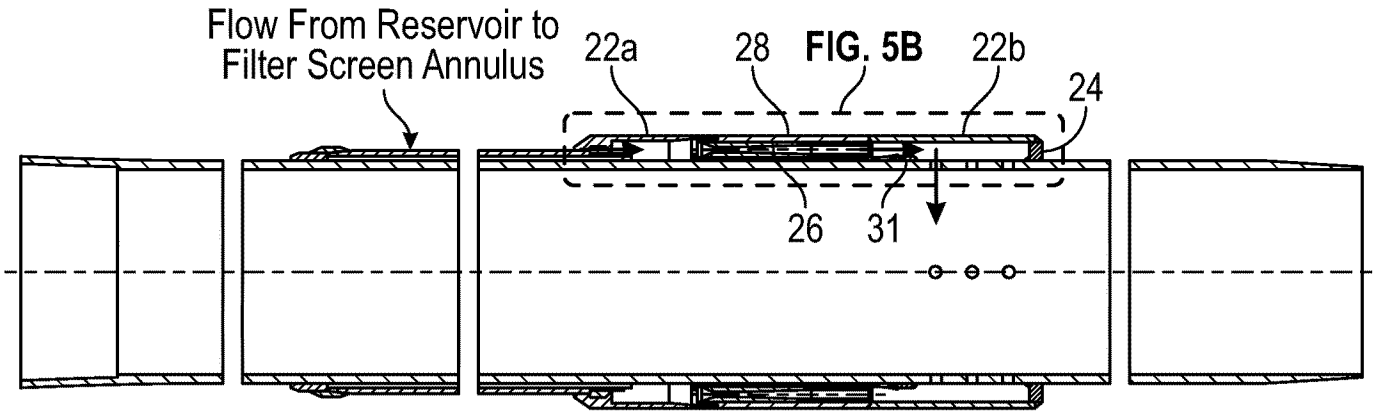
FIGS. 5A and 5B show a flow path of production fluid from a reservoir to the surface through the sand control assembly integrating the at least one inflow control device shown in FIGS. 3B and 4, according to one or more embodiments of the present disclosure.
Figure 5B:
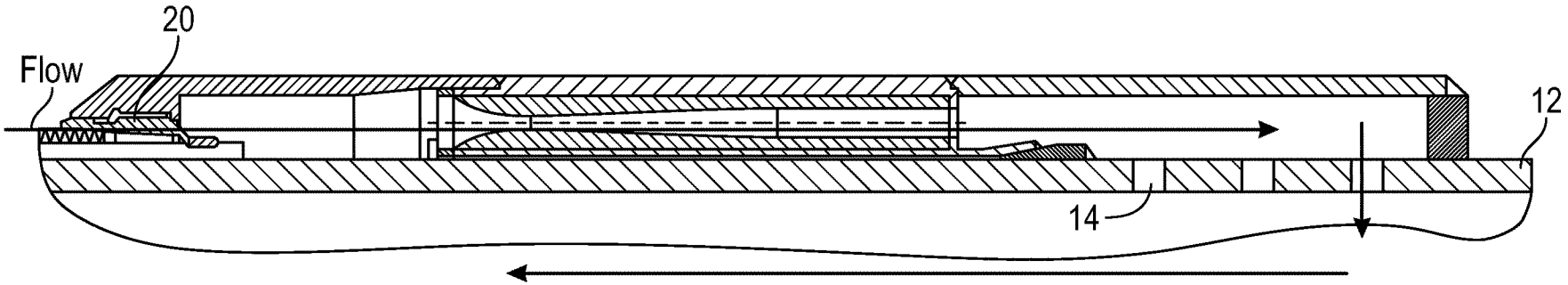

Referring now to FIGS. 5A and 5B, a flow path of production fluid from a reservoir to the surface through the sand control assembly 10 integrating the at least one flow control device or nozzle 26 shown in FIGS. 3B and 4, according to one or more embodiments of the present disclosure is shown. As shown in FIGS. 5A and 5B, the sand control assembly 10 according to one or more embodiments of the present disclosure may include a flow path through the filter screen 16 from a reservoir external of the sand control assembly, into a filter screen annulus between the filter screen 16 and the base pipe 12, through a plurality of slots of the bypass ring 20, into a high pressure annulus defined by an outer diameter of the base pipe 12 and an outer diameter of the high pressure housing 22*a*, through the inflow control device or nozzle 26, into a low pressure annulus defined by the outer diameter of the base pipe 12 and an outer diameter of the low pressure housing 22*b*, into the base pipe 12 via the at least one perforation 14, and uphole to the surface for production.

Figure 6A:
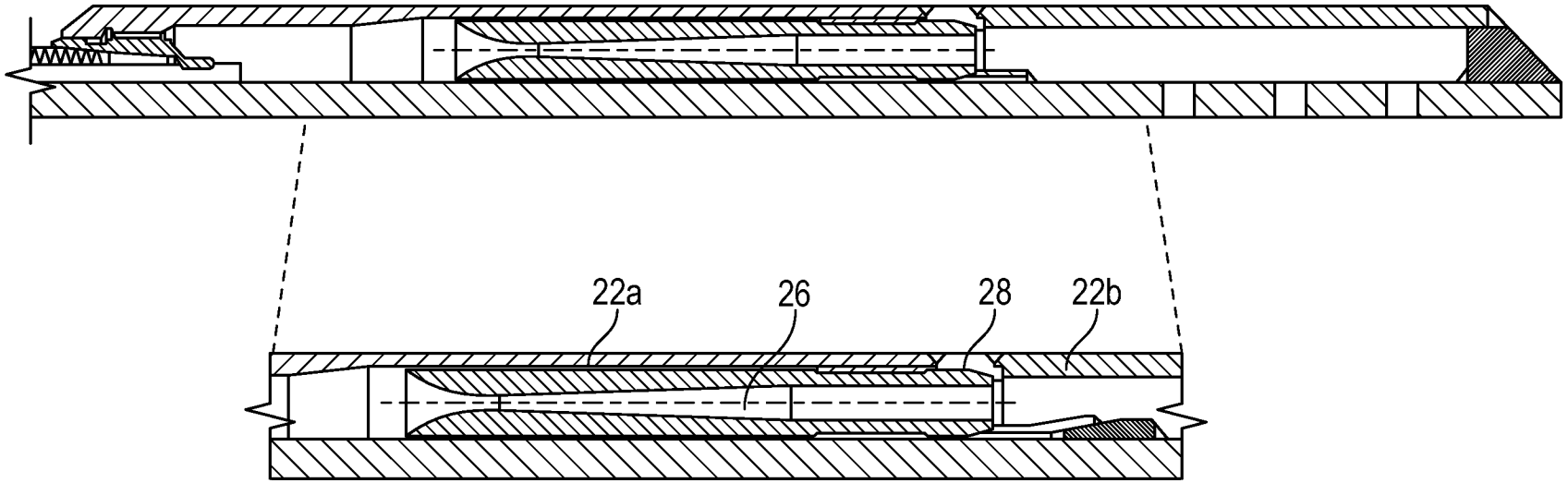
FIGS. 6A and 6B show different examples of how an inflow control device may be integrated into a sand control assembly housing, according to one or more embodiments of the present disclosure.
Figure 6B:
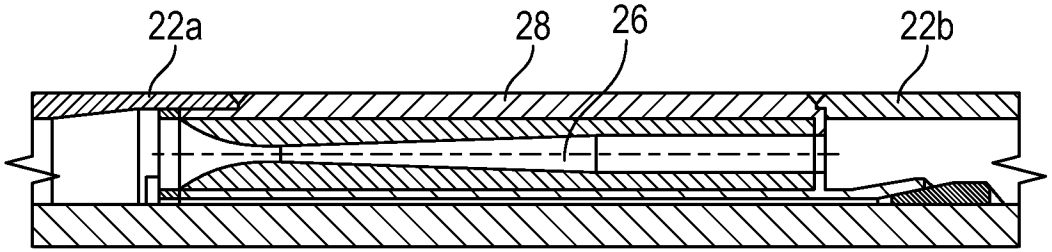

Referring now to FIGS. 6A and 6B, different examples of how an inflow control device or nozzle 26 may be integrated into a sand screen assemble 10 housing 22 are shown, according to one or more embodiments of the present disclosure. In FIG. 6A, for example, the nozzle ring 28 is relatively short compared to the housing 22. In contrast, FIG. 6B shows how a nozzle ring 28 that is relative long compared to the housing 22 may be integrated therein.

Figure 7B:
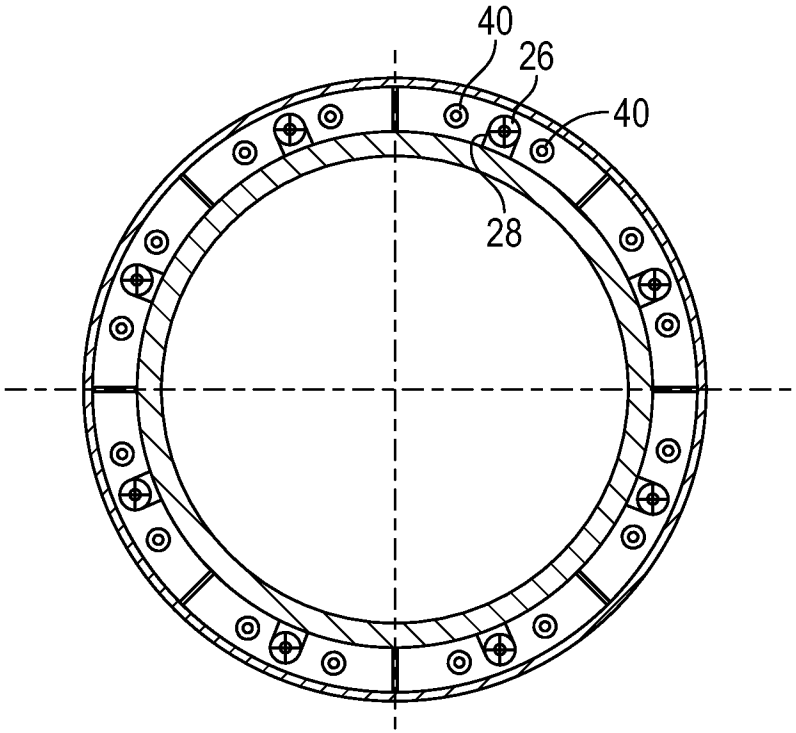
FIG. 7B shows a cross-sectional view of the sand control assembly integrating the at least one nozzle shown in FIG. 7A, according to one or more embodiments of the present disclosure.
Figure 7A:
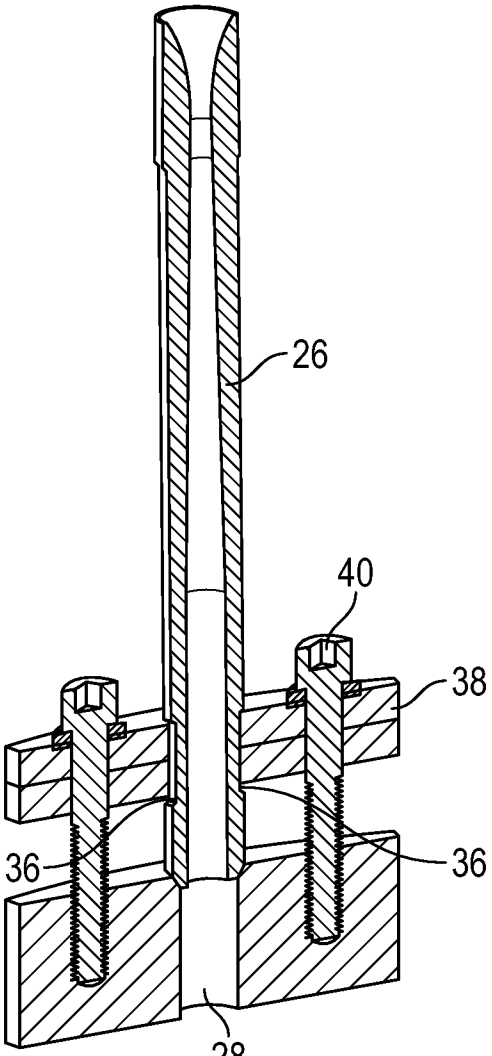
FIG. 7A shows how an end of at least one nozzle may be forced into a nozzle ring to create a seal for a sand control assembly integrating the at least one nozzle, according to one or more embodiments of the present disclosure.

Referring now to FIG. 7A, how an end of at least one nozzle 26 may be forced into a nozzle ring 28 to create a seal for a sand control assembly 10 integrating the at least one nozzle 26, according to one or more embodiments of the present disclosure is shown. As shown in FIG. 7A, the nozzle 26 may include a pair of shoulders 36 near one end according to one or more embodiments of the present disclosure. As shown in FIG. 7A, nozzle 26 is configured to accommodate a fixture 38, which may rest on the pair of shoulders 36. According to one or more embodiments of the present disclosure, the fixture 38 may include one or more through holes to accommodate one or more bolts 40 or another type of fastener. In operation, the combination of the nozzle 26 having the shoulders 36, the fixture 38, and the bolts 40 or fasteners may facilitate forcing an end of the nozzle 26 into the nozzle ring 28, as the bolts 40 are tightened, for example. Forcing of the nozzle 26 into the nozzle ring 28 in this way may create a seal to ensure that no fluid flow bypasses the nozzle 26 according to one or more embodiments of the present disclosure. In one or more embodiments of the present disclosure, the sealing distance with respect to the nozzle 26 and the nozzle ring 28 may be kept as small as possible to prevent undesirable loosening of the seal due to thermal expansion differences in the materials (i.e., the nozzle 26, the nozzle ring 28, and the bolts 40 in the fixture 38). FIG. 7B shows a cross-sectional view of the sand control assembly 10 integrating the at least one nozzle 26 sealed in the nozzle ring 28 shown in FIG. 7A, according to one or more embodiments of the present disclosure. In view of FIG. 7B, a bolt 40 or fastener on either side of a nozzle 26 is shown in each segment, as previously described with respect to FIG. 7A.

Figure 8A:
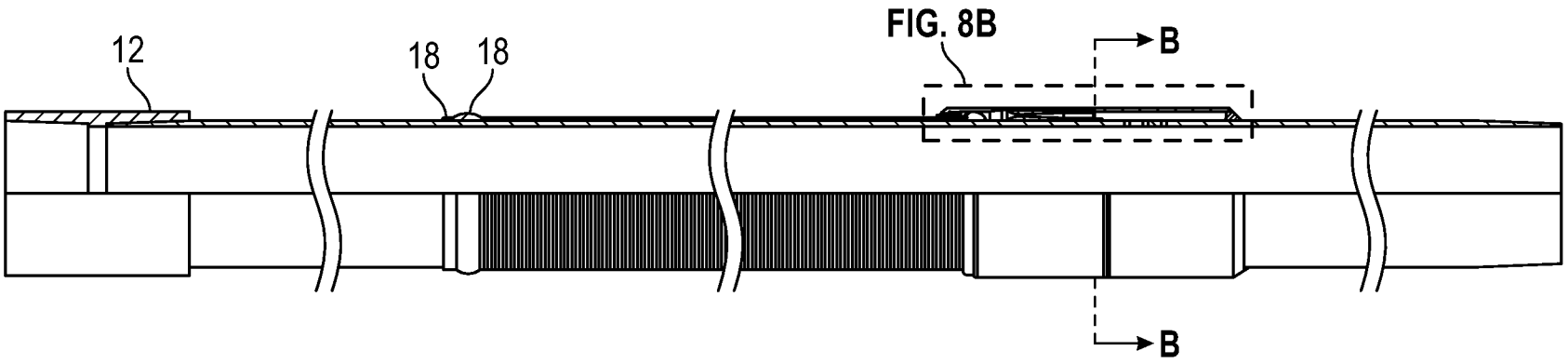
FIG. 8A shows a half cross-sectional view of a sand control assembly integrating an inflow control device according to one or more embodiments of the present disclosure.

Referring now to FIG. 8A, a half cross-sectional view of a sand control assembly 10 integrating an inflow control device 26 according to one or more embodiments of the present disclosure is shown. Specifically, FIG. 8A shows that the sand control assembly 10 according to one or more embodiments of the present disclosure may include a single inflow control device or nozzle 26. However, as previously described, the sand control assembly 10 may include multiple inflow control devices or nozzles 26 without departing from the scope of the present disclosure. FIG. 8A also shows that the sand control assembly 10 may include a base pipe 12 having a plurality of perforations 14, and a filter screen 16 secured to an exterior of the base pipe 12 via at least one end ring 18 at a first end of the filter screen 16, as previously described.

Figure 8B:
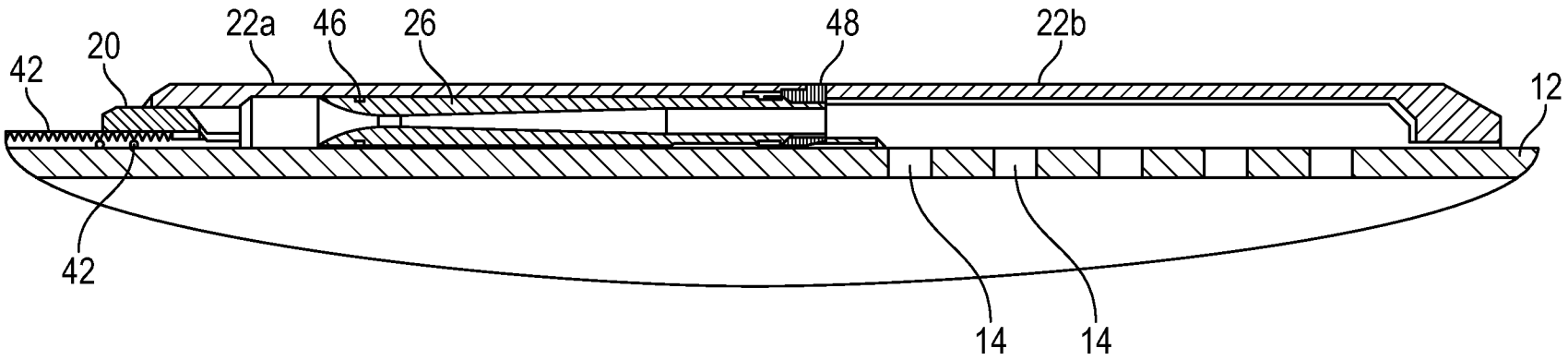
FIG. 8B shows an enlarged partial view of the half cross-sectional view shown in FIG. 8A of the sand control assembly integrating the inflow control device according to one or more embodiments of the present disclosure.

Referring now to FIG. 8B, an enlarged partial view of the half cross-sectional view shown in FIG. 8A of the sand control assembly 10 integrating the inflow control device or nozzle 26 according to one or more embodiments of the present disclosure is shown. For example, the perforated 14 base pipe 12 of the sand control assembly 10 is more clearly shown in FIG. 8B. As also shown in FIG. 8B, the filter screen 16 of the sand control assembly 10 may include wire 42, such as wrap wire and axial wire, in one or more embodiments of the present disclosure. FIG. 8B also shows that the sand control assembly 10 according to one or more embodiments of the present disclosure may also include a bypass ring 20, a high pressure housing 22*a*, the integrated inflow control device or nozzle 26, a nozzle ring 28, and a low pressure housing 22*b*, as previously described. As further shown in FIG. 8B, an O-ring 46 or other seal may be disposed within the high pressure housing 22*a* and proximate an inlet of the inflow control device or nozzle 26, according to one or more embodiments of the present disclosure.

Figure 8C:
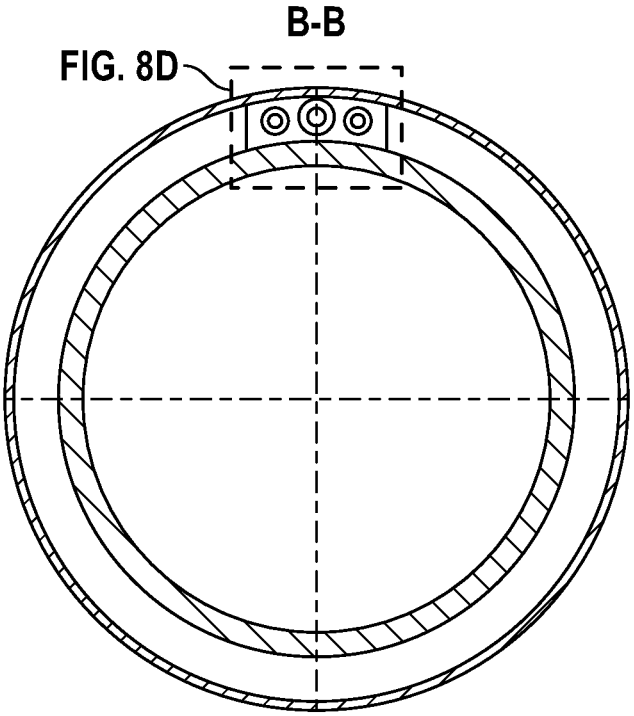
FIG. 8C shows a cross-sectional view of the sand control assembly integrating the inflow control device of FIG. 8A along the line B-B, according to one or more embodiments of the present disclosure.

Referring now to FIG. 8C, a cross-sectional view of the sand control assembly 10 integrating the inflow control device or nozzle 26 of FIG. 8A along the line B-B, according to one or more embodiments of the present disclosure is shown. Specifically, the view shown in FIG. 8C shows the single inflow control device or nozzle 26, according to one or more embodiments of the present disclosure. FIG. 8C also shows that the inflow control device or nozzle 26 according to one or more embodiments of the present disclosure may be disposed concentrically with the longitudinal axis of the base pipe 12, for example.

Figure 8D:
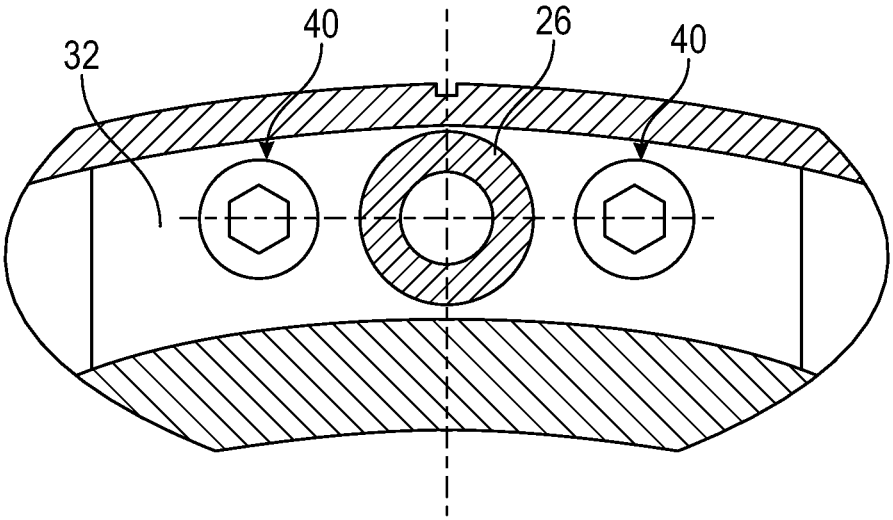
FIG. 8D is an enlarged partial view of the cross-sectional view of the sand control assembly integrating the inflow control device of FIG. 8C, according to one or more embodiments of the present disclosure.

Referring now to FIG. 8D, an enlarged view of the components encircled at H shown in FIG. 8C is shown. Specifically, FIG. 8D shows set screws 30 on a face plate of a retaining ring 32, which may be used to affix the nozzle 26 around the perimeter of the base pipe 12 of the sand control assembly 10, according to one or more embodiments of the present disclosure.

Figure 9A:
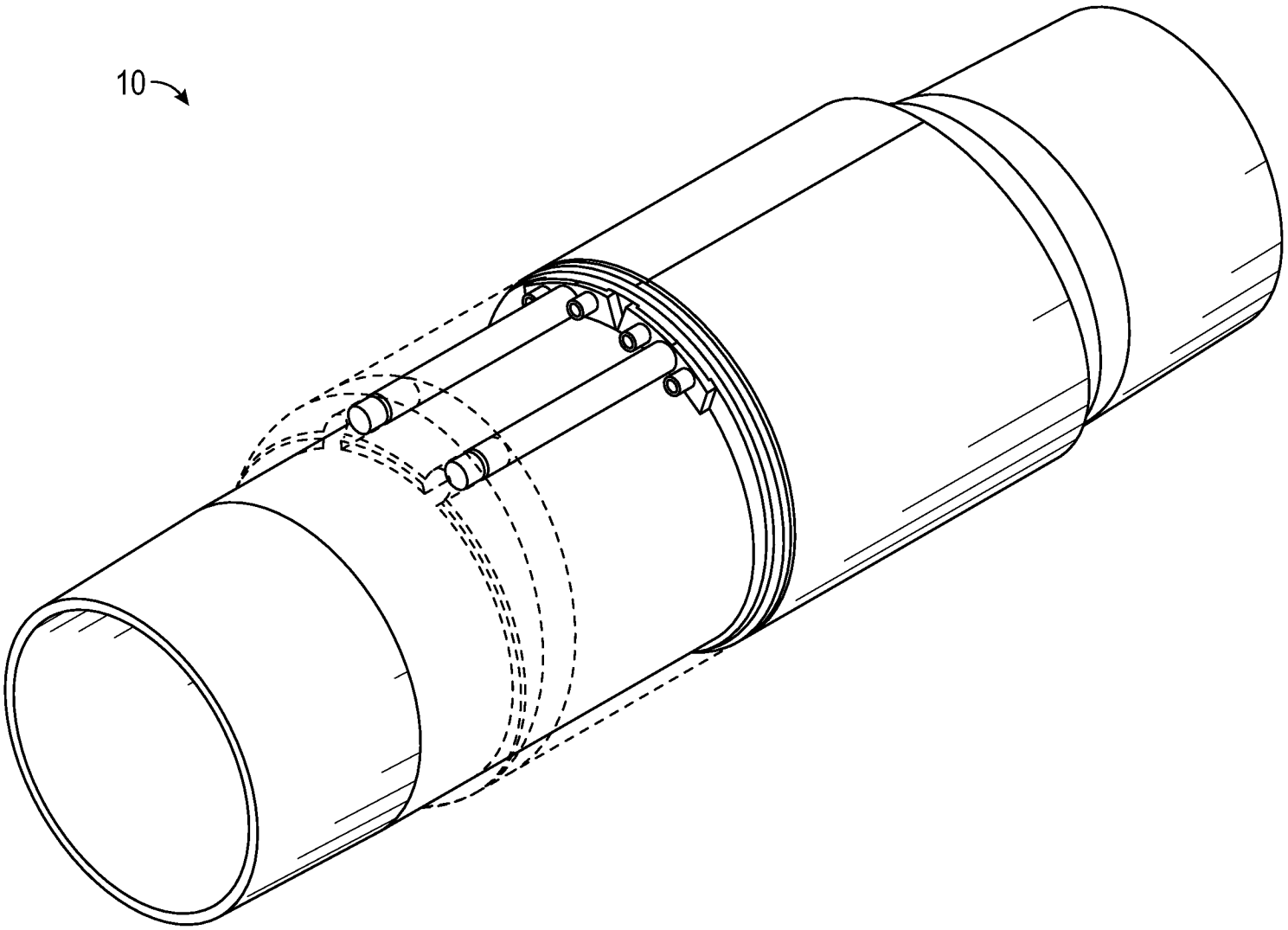
FIG. 9A is a perspective view of a sand control assembly integrating multiple inflow control devices according to one or more embodiments of the present disclosure.

Referring now to FIG. 9A, a perspective view of a sand control assembly 10 integrating multiple inflow control devices or nozzles 26 according to one or more embodiments of the present disclosure is shown. As further shown in FIG. 9A, the sand control assembly 10 according to one or more embodiments of the present disclosure may omit the filter screen 16, for example.

Figure 9B:
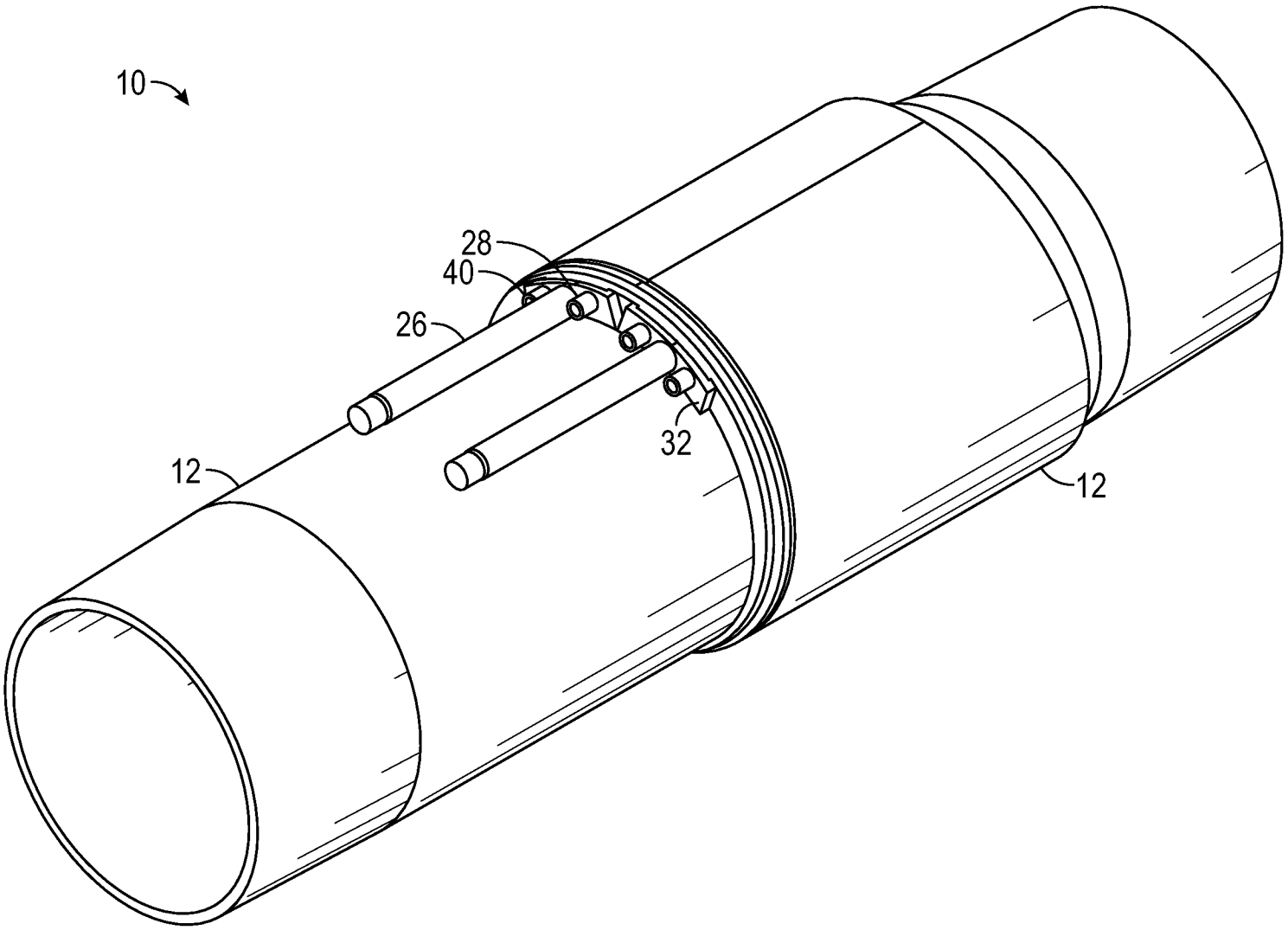
FIG. 9B is a detailed view of the sand control assembly integrating multiple inflow control devices shown in FIG. 9A, according to one or more embodiments of the present disclosure.

Referring now to FIG. 9B, a detailed view of the sand control assembly 10 integrating multiple inflow control devices or nozzles 26 without a filter screen 16 according to one or more embodiments of the present disclosure is shown. As shown, the sand control assembly 10 may include a base pipe 12, and multiple nozzles 26 affixed around the perimeter of the base pipe 12 via set screws 30 on a face plate of a retaining ring 32, for example. As previously described, the nozzles 26 may be forced into nozzle rings 28 secured to the base pipe 12, thereby creating a seal, as previously described.

Figure 9C:
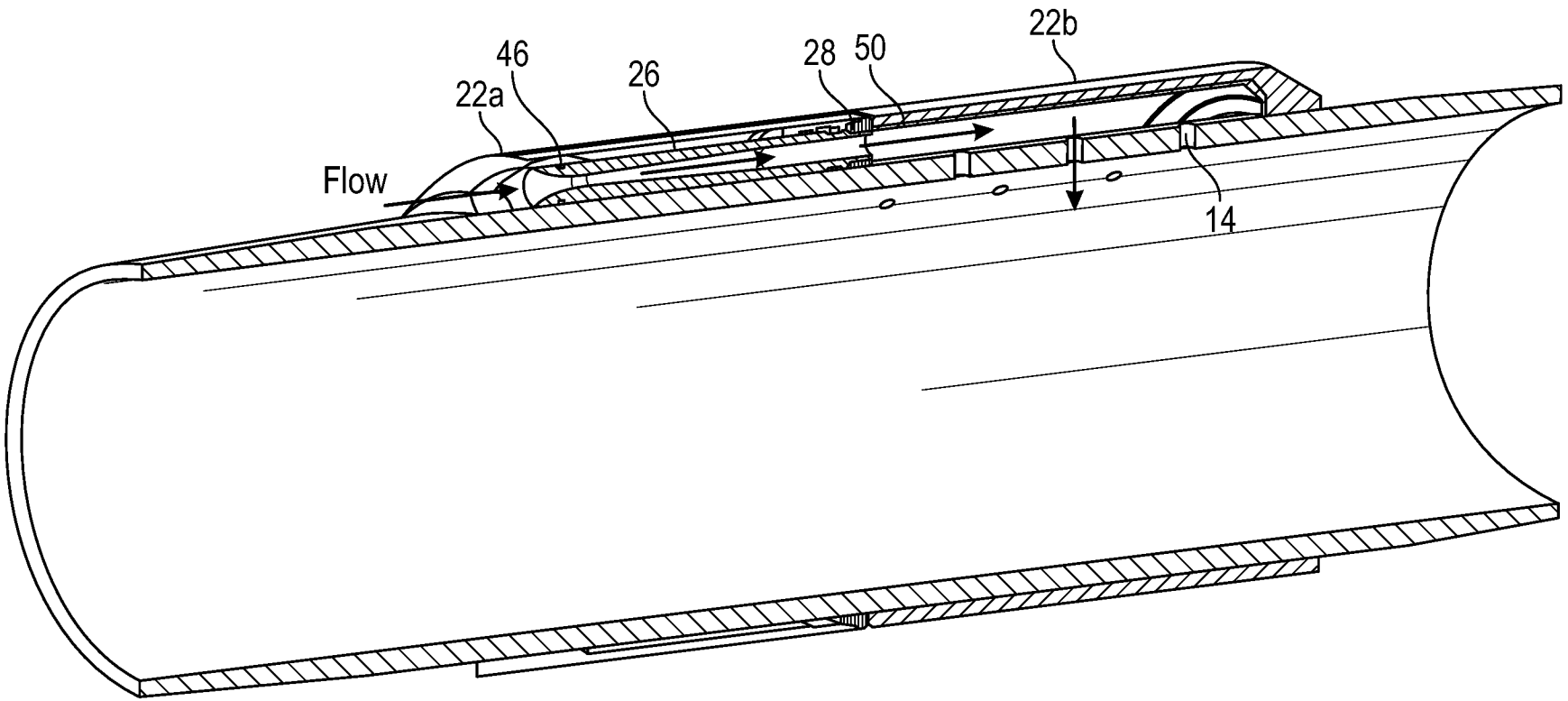
FIG. 9C is a partial cross-sectional view of the sand control assembly showing one of the multiple inflow control devices shown in FIG. 9B, according to one or more embodiments of the present disclosure.

Referring now to FIG. 9C, a partial cross-sectional view of the sand control assembly 10 showing one of the multiple inflow control devices or nozzles 26 shown in FIG. 9B is shown. Specifically, according to one or more embodiments of the present disclosure, FIG. 9C shows the perforated 14 base pipe 12, the high pressure housing 22*a*, the nozzle 26, the nozzle ring 28, and the low pressure housing 22*b* of the sand control assembly 10, as previously described, but without a filter screen 16. According to one or more embodiments of the present disclosure, the sand control assembly 10 may include a flow path from a reservoir external of the sand control assembly 10, into a high pressure annulus defined by an outer diameter of the base pipe 12 and an outer diameter of the high pressure housing 22*a*, through the inflow control device or nozzle 36, into a low pressure annulus defined by the outer diameter of the base pipe 12 and an outer diameter of the low pressure housing 22*b*, into the base pipe 12 via the at least one perforation 14, and uphole to surface for production, for example. As also shown in FIG. 9C, an O-ring 46 or other seal may be disposed within the high pressure housing 22*a* and proximate an inlet of the inflow control device or nozzle 26, as previously described. As also shown in FIG. 9C, at least an interior wall of the low pressure housing 22*b* of the sand control assembly 10 may be at least partially coated with an erosion resistant coating, which may include tungsten carbide, hardide, carbide, or ceramic, for example.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A sand control assembly, comprising:

a base pipe having at least one perforation;

a housing disposed around the exterior of the base pipe, the housing being secured to a bypass ring at a first end of the housing and secured to the base pipe at a second end of the housing via a weld end ring;

at least one inflow control device integrated within the housing via an associated ring secured to the housing and the base pipe, the at least one inflow control device and the associated ring creating a seal;

a centralizing ring secured to the base pipe that centers the at least one inflow control device with respect to the base pipe; and wherein a longitudinal axis of the at least one inflow control device is parallel to a longitudinal axis of the base pipe.

2. The sand control assembly of claim 1, wherein the at least one inflow control device is a nozzle and the associated ring is a nozzle ring.

3. The sand control assembly of claim 2, wherein the nozzle is contoured, defining a first diameter and a second diameter, wherein the first diameter is a smallest diameter of the nozzle and the second diameter is a largest diameter of the nozzle, and wherein the largest diameter is twice the smallest diameter.

4. The sand control assembly of claim 1, wherein the at least one inflow control device is disposed eccentrically with respect to the longitudinal axis of the base pipe.

5. The sand control assembly of claim 1, wherein the associated ring is welded to the housing and the base pipe.

6. The sand control assembly of claim 1, wherein the housing comprises: a high pressure housing associated with an inlet of the at least one inflow control device; and a low pressure housing associated with an outlet of the at least one inflow control device.

7. The sand control assembly of claim 6, wherein an interior wall of the low pressure housing is at least partially coated with an erosion resistant coating.

8. The sand control assembly of claim 6, further comprising a flow path through the filter screen from a reservoir external of the sand control assembly, into a filter screen annulus between the filter screen and the base pipe, through a plurality of slots of the bypass ring, into a high pressure annulus defined by an outer diameter of the base pipe and an outer diameter of the high pressure housing, through the at least one inflow control device, into a low pressure annulus defined by the outer diameter of the base pipe and an outer diameter of the low pressure housing, into the base pipe via the at least one perforation, and uphole to surface for production.

9. The sand control assembly of claim 1, further comprising:

a filter screen comprising a first end and a second end, wherein the filter screen is secured to an exterior of the base pipe via at least one end ring and the first end of the filter screen and the bypass ring at the second end of the filter screen.

10. A method comprising:

providing a perforated base pipe;

securing at least one nozzle ring to the base pipe;

welding the low pressure housing to the at least one nozzle ring;

welding the low pressure housing to the base pipe via a weld end ring;

inserting a nozzle into each of the at least one nozzle rings such that a longitudinal axis of the nozzle is parallel to a longitudinal axis of the base pipe;

forcing the nozzle into each of the at least one nozzle rings, thereby creating a seal; and securing a high pressure housing to the bypass ring and to the at least one nozzle ring.

11. The method of claim 10, wherein the nozzle is contoured, defining a first diameter and a second diameter, wherein the first diameter is a smallest diameter of the nozzle and the second diameter is a largest diameter of the nozzle, and wherein the largest diameter is twice the smallest diameter.

12. The method of claim 10, further comprising centering the nozzle with respect to the base pipe.

13. The method of claim 10, further comprising disposing the nozzle eccentrically with respect to the longitudinal axis of the base pipe.

14. The method of claim 10, further comprising securing a filter screen having a first end and a second end to an exterior of the perforated base pipe via at least one end ring at the first end and a bypass ring at the second end.

15. The method of claim 10, wherein securing the high pressure housing to the at least one nozzle ring comprises welding the high pressure housing to the at least one nozzle ring.

16. The method of claim 10, wherein the high pressure housing is associated with an inlet of the nozzle, and wherein the low pressure housing is associated with an outlet of the nozzle.

17. A method comprising:

providing a perforated base pipe;

securing at least one nozzle ring to the base pipe;

securing a low pressure housing to the at least one nozzle ring and to the base pipe;

inserting a nozzle into each of the at least one nozzle rings such that a longitudinal axis of the nozzle is parallel to a longitudinal axis of the base pipe;

forcing the nozzle into each of the at least one nozzle rings, thereby creating a seal;

securing a high pressure housing to the bypass ring; and welding the high pressure housing to the at least one nozzle ring.

* * * * *